US007883354B1

(12) United States Patent
Ma et al.

(10) Patent No.: US 7,883,354 B1
(45) Date of Patent: Feb. 8, 2011

(54) MODULAR PLUG

(75) Inventors: Xian-Wei Ma, Shenzhen (CN); Ting Luo, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Hsien (TW)

( * ) Notice: Subject to any disclaimer, the term of this patent is extended or adjusted under 35 U.S.C. 154(b) by 0 days.

(21) Appl. No.: 12/869,700

(22) Filed: Aug. 26, 2010

(51) Int. Cl.
*H01R 4/24* (2006.01)

(52) U.S. Cl. ..... 439/418; 439/676; 439/460

(58) Field of Classification Search ..... 439/418, 439/460, 676, 387
See application file for complete search history.

(56) References Cited

U.S. PATENT DOCUMENTS 4,193,658 A * 3/1980 Dittmann et al. ..... 439/418
6,077,122 A * 6/2000 Elkhatib et al. ..... 439/417
6,080,007 A * 6/2000 Dupuis et al. ..... 439/418
6,116,943 A * 9/2000 Ferrill et al. ..... 439/418
6,368,143 B1 * 4/2002 Adams ..... 439/418
6,561,838 B1 * 5/2003 Blichfeldt ..... 439/418
6,592,397 B2 * 7/2003 Pocrass ..... 439/418
6,682,363 B1 * 1/2004 Chang ..... 439/418
6,764,333 B2 * 7/2004 Pocrass ..... 439/418
6,932,641 B1 * 8/2005 Liao ..... 439/460
7,001,204 B1 * 2/2006 Lin ..... 439/418
7,670,193 B2 * 3/2010 Milette et al. ..... 439/676

* cited by examiner

*Primary Examiner*—Briggitte R Hammond
(74) *Attorney, Agent, or Firm*—Zhigang Ma

(57) ABSTRACT

A modular plug includes a main body and a fixing block. The main body includes an upper housing, a lower housing, and blades. The upper housing includes a first top surface defining slits for respectively retaining one contact and a first bottom surface defining a first cavity and indents extending from one sidewall of the first cavity. The first bottom surface includes wires being connected with one contact. The lower housing includes a second top surface, abutting against the first bottom surface of the upper housing, and a second bottom surface. The second top surface defines a second cavity and slots extending from one sidewall of the second cavity. The second bottom surface forms an elastic tab extending therefrom. The blades are respectively received in one indent. The fixing block is fitted in to the first cavity and the second cavity and includes fixing portions fixing cores of a cable.

5 Claims, 5 Drawing Sheets

MODULAR PLUG

BACKGROUND

1. Technical Field

The present disclosure relates to a modular plug that can fix a cable without a modular crimper.

2. Description of Related Art

A modular plug and a modular jack are know to be used in a telephone system or a LAN (Local Area Network). The modular plug can be fixed to a cable using a modular crimper. However, using a crimper to connect the plug and the cable is time-consuming.

Therefore, what is needed is a modular plug to overcome the shortcomings described above.

BRIEF DESCRIPTION OF THE DRAWINGS

The components of the drawings are not necessarily drawn to scale, the emphasis instead being placed upon clearly illustrating the principles of a modular plug. Moreover, in the drawings, like reference numerals designate corresponding parts throughout several views.

DETAILED DESCRIPTION

Figure 1:
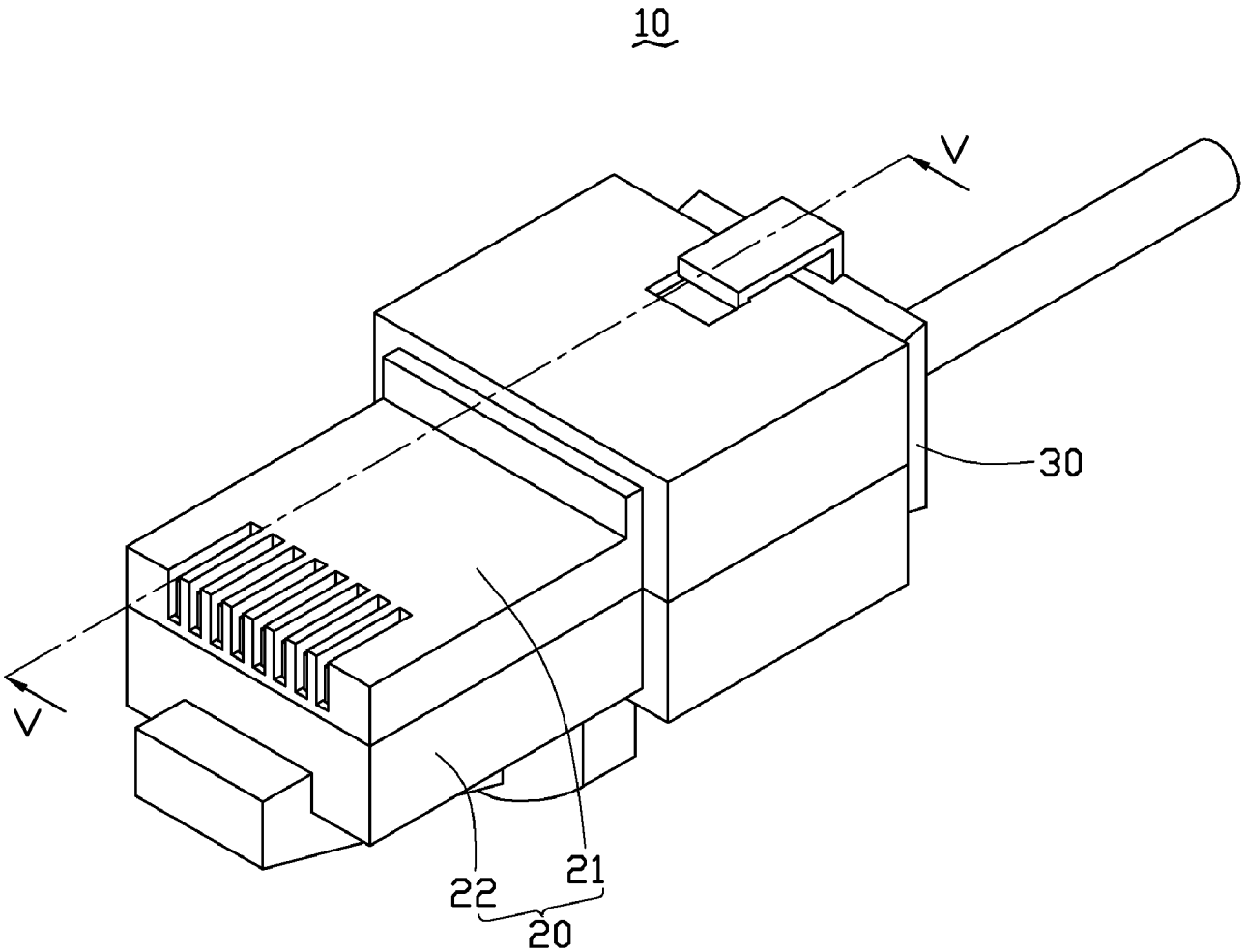
FIG. 1 is an isometric view of a modular plug according to an exemplary embodiment.
Figure 2:
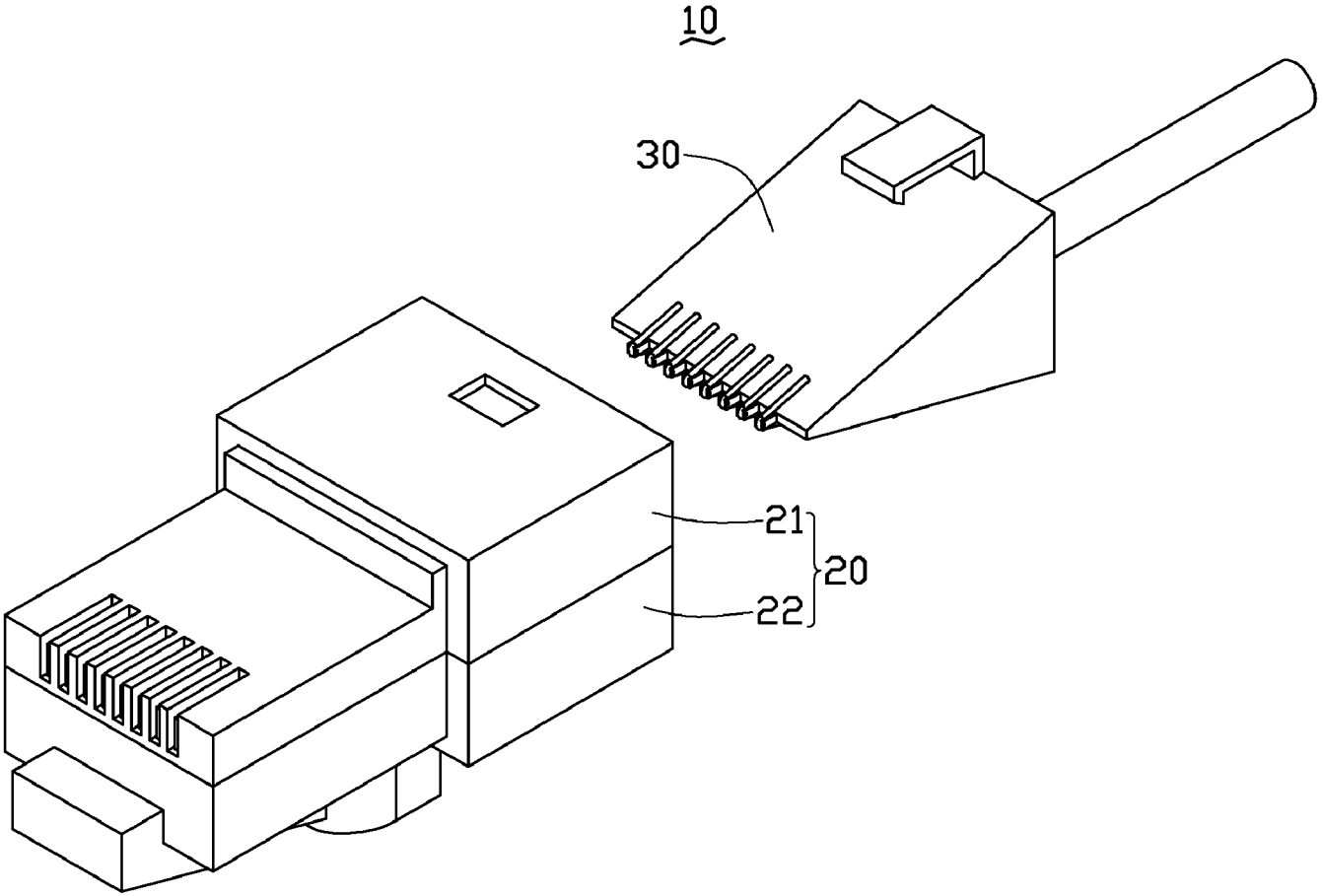
FIG. 2 is a partially exploded, isometric view of the modular plug of FIG. 1.

Referring to FIGS. 1 and 2, a modular plug 10 according to an exemplary embodiment is illustrated. The modular plug 10 includes a main body 20 and a fixing block 30. The main body 20 includes an upper housing 21 and a lower housing 22 fastened together and can be fitted into a coupling modular jack (not shown). The upper housing 21 and the lower housing 22 cooperatively define a receiving space 23 (see FIG. 5) for receiving the fixing block 30.

Figure 3:
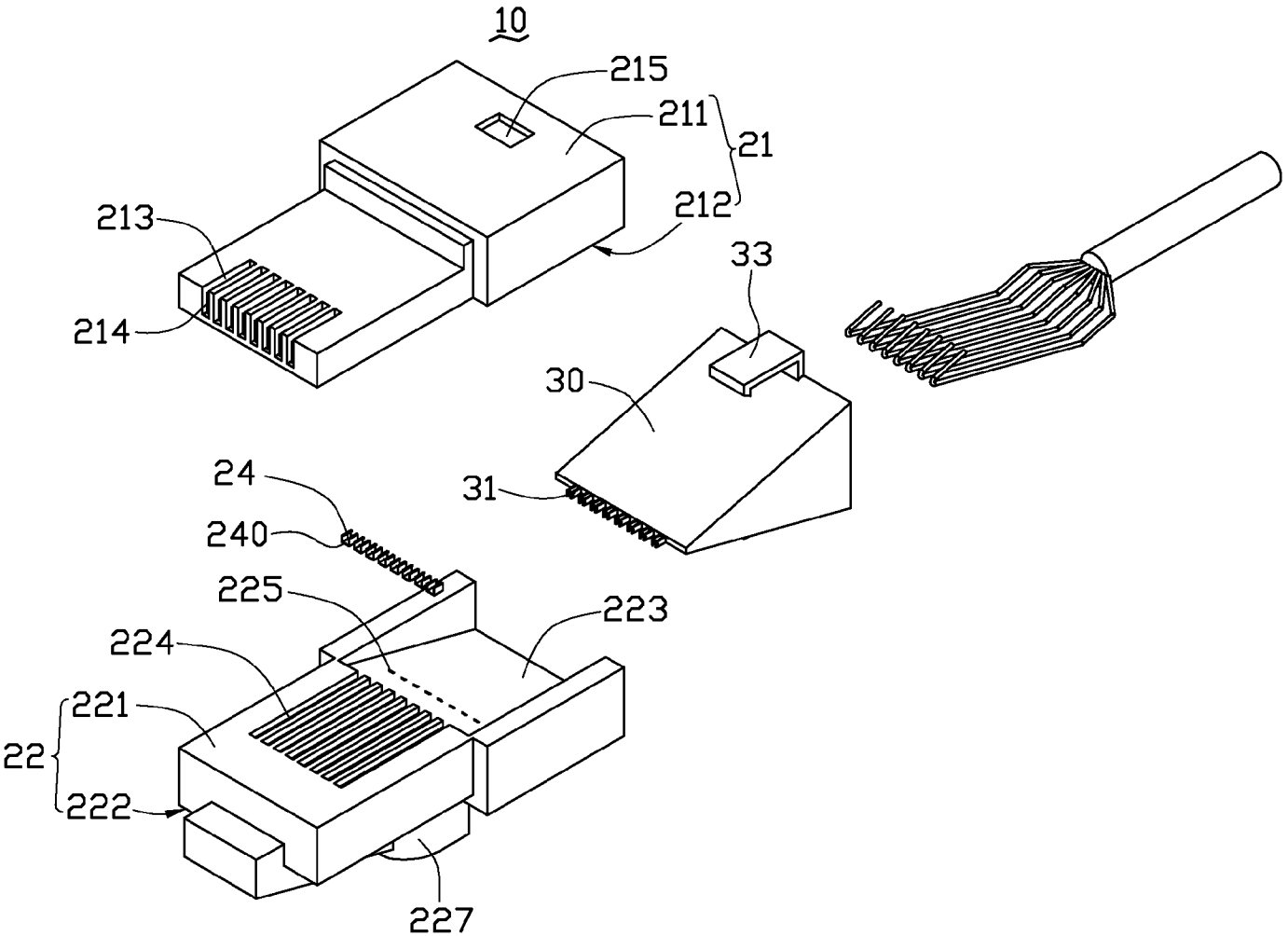
FIG. 3 is a further exploded, isometric view of the modular plug of FIG. 2.
Figure 4:
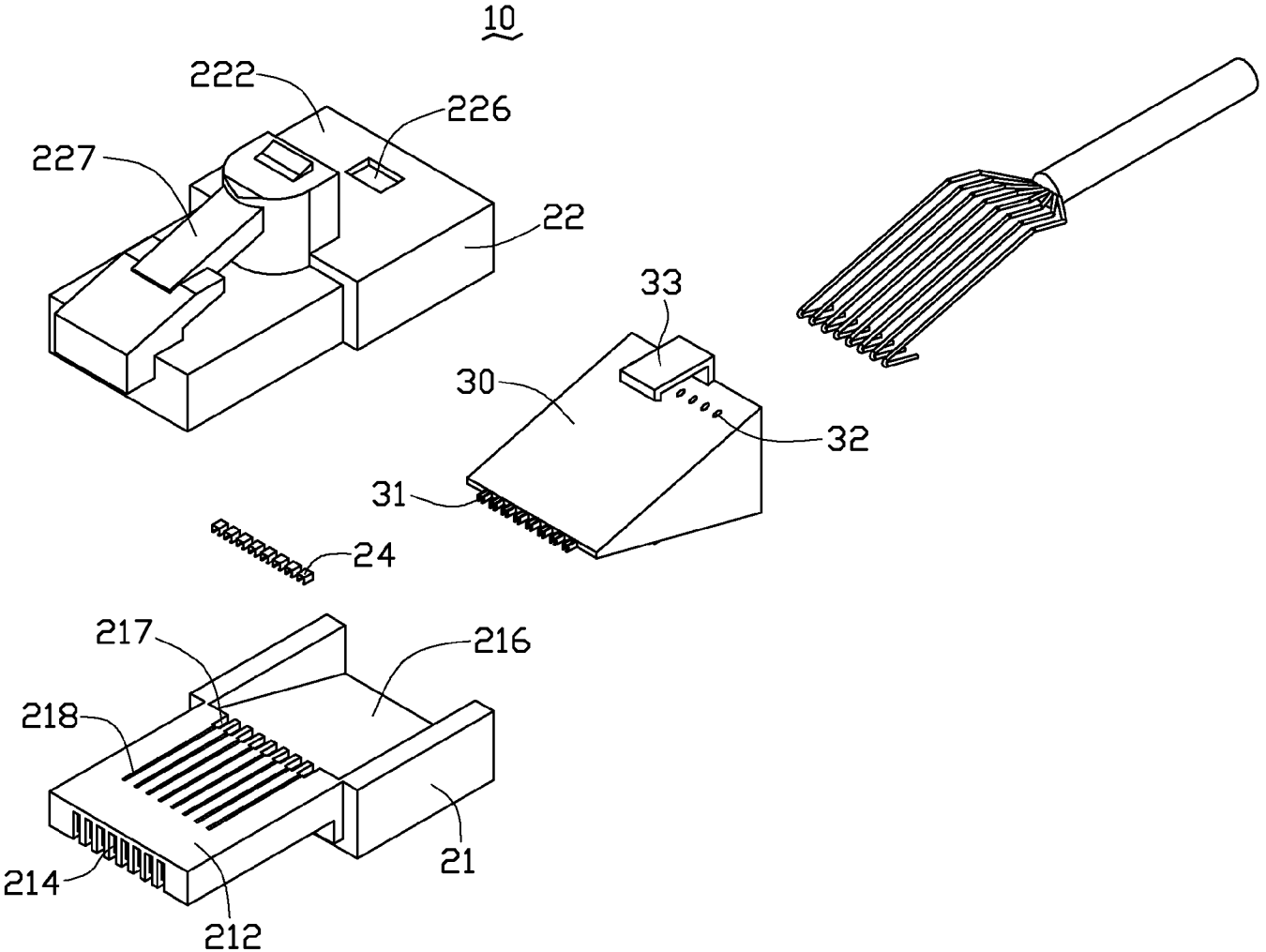
FIG. 4 is a view similar to FIG. 3, but viewed from a reverse viewpoint.

Referring to FIGS. 3 and 4, the upper housing 21 includes a first top surface 211 and a first bottom surface 212. The first top surface 211 is a substantially stepped surface and defines a number of parallel slits 213 in an end. Each slit 213 is used to retain one contact 214. In the embodiment, the number of the slits 213 is eight and can vary according to need. The first top surface 211 defines a first recess 215 in an opposite end from the slits 213. The first bottom surface 212 defines a first cavity 216, a number of indents 217 extending from one sidewall of the first cavity 216 and corresponding to the contacts 214, and includes a number of wires 218 each connected with one contact 214 and extending to a corresponding one of indents 217.

The lower housing 22 includes a second top surface 221 and a second bottom surface 222. The second top surface 221 abuts against the first bottom surface 212 of the upper housing 21. The second top surface 221 defines a second cavity 223 and a number of slots 224 extending from one sidewall of the second cavity 223. The lower housing 22 further includes a number of latching protrusions 225 on a bottom of the second cavity 223. The second bottom surface 222 defines a second recess 226 corresponding to the first recess 215 of the upper housing 21 and forms an elastic tab 227 extending in a slope from the second bottom surface 222.

The main body 20 further includes a number of blades 24 respectively fixed in the indents 217. The blades 24 are respectively connected with the eight contacts 214 through the wires 218. Each blade 24 includes a cutting edge 240 that is substantially flush with the first bottom surface 212 of the upper housing 21.

The fixing block 30 is wedge shaped and includes a number of fixing portions 31 protruding from one edge and two hooks 33 protruding from the other two edges. The fixing block 30 also defines a number of through holes 32 corresponding to the fixing portions 31.

Figure 5:
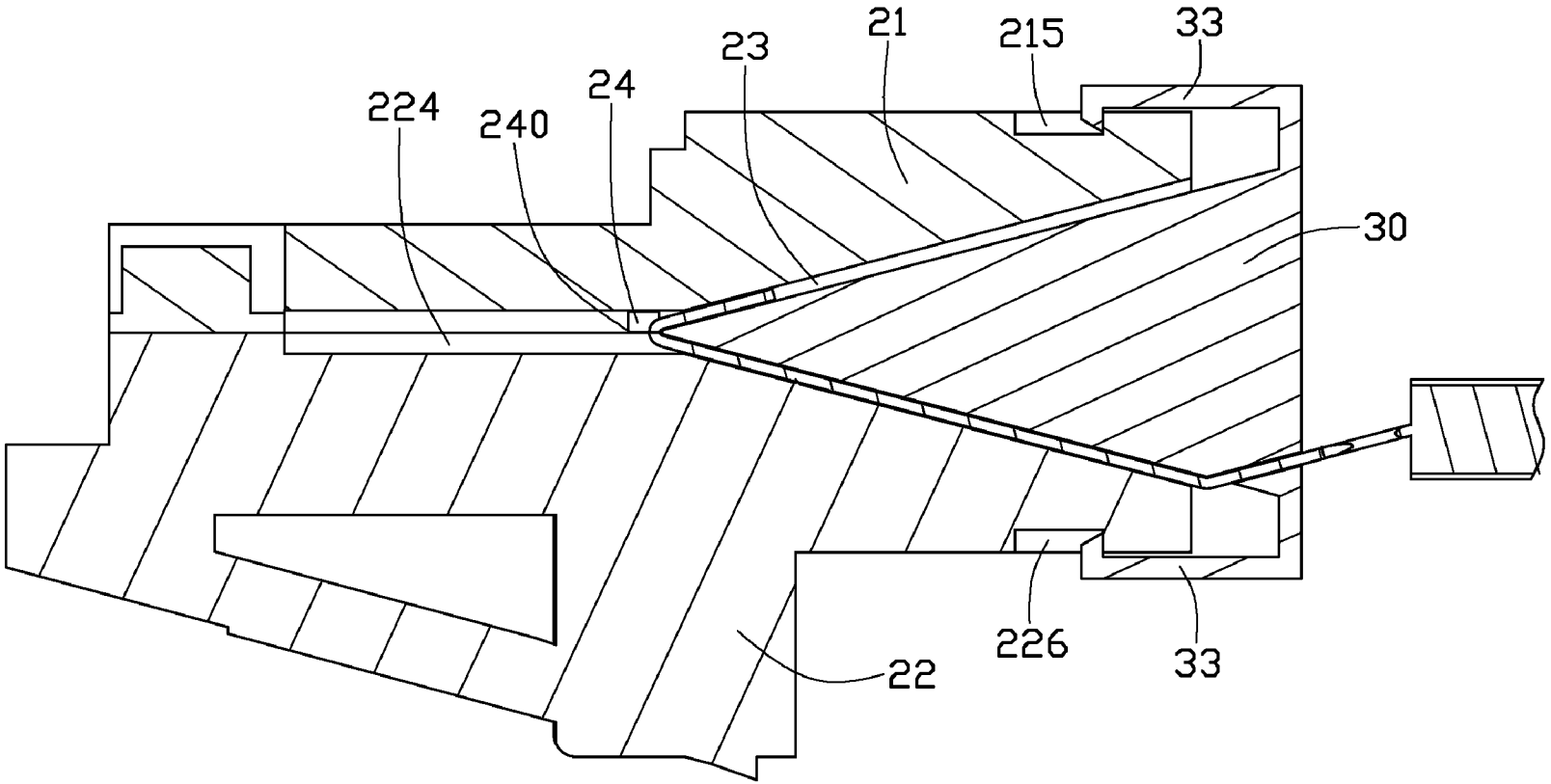
FIG. 5 is a cross-sectional view of the modular plug of FIG. 1, taken along line V-V of FIG. 1.

Referring to FIG. 5, after assembly, the upper housing 21 and the lower housing 22 are fastened together, and the first cavity 216 and the second cavity 223 cooperatively define the receiving space 23. The fixing block 30 fixes a number of cores of a cable on the fixing portions 31 through the through holes 32 and is fitted into the receiving space 23. The cutting edges 240 of the blades 24 stab the cores of the cable to respectively connect one core to one contact 214. Simultaneously, the hooks 33 latch into the first recess 215 and the second recess 226 of the main body 20 to fix the fixing block 30, and the latching protrusions 225 respectively latch into the cores.

Although the present disclosure has been specifically described on the basis of certain embodiments thereof, the disclosure is not to be construed as being limited to the described embodiments. Various changes or modifications may be made to the embodiments without departing from the scope and spirit of the disclosure.

What is claimed is:

1. A modular plug comprising:

a main body comprising:

an upper housing comprising a first top surface and a first bottom surface, the first top surface defining a plurality of slits in an end of the upper housing each for respectively retaining a contact, the first bottom surface defining a first cavity and comprising a plurality of indents extending from one sidewall of the first cavity, and a plurality of wires, each of the plurality of wires being connected with one of the plurality of contacts and extending into one of the plurality of indents;

a lower housing comprising a second top surface and a second bottom surface, the second top surface abutting against the first bottom surface of the upper housing, the second top surface defining a second cavity creating a receiving space together with the first cavity and a plurality of slots extending from one sidewall of the second cavity, and the second bottom surface comprising an elastic tab extending therefrom; and a plurality of blades respectively each received in one of the plurality of indents, each of the blades defining a cutting edge and being connected with one contact through one corresponding wire; and a fixing block comprising a plurality of fixing portions protruding from one edge, the fixing portions fixing a plurality of cores of a cable;

wherein when the fixing block is fitted into the receiving space, the blades stab the cores of the cable to respectively connect one core to one corresponding contact.

2. The modular plug as described in claim 1, wherein each number of the pluralities of slits, contacts, blades, and fixing portions is eight.

3. The modular plug as described in claim 1, wherein the lower housing comprises eight latching protrusions on a bottom of the second cavity, each latching portion respectively latching into one core of the cable.

4. The modular plug as described in claim 1, wherein the main body further defines at least one recess, the fixing block defines at least one hook latched into the at least one recess to fix the fixing block to the main body.

5. The modular plug as described in claim 4, wherein the at least one recess comprises a first recess defined in the first top surface of the upper housing and a second recess defined in the second bottom surface of the lower housing, the number of the at least one hook is two.

* * * * *